US006109520A

United States Patent [19]

Ricard

[11] Patent Number: 6,109,520

[45] Date of Patent: Aug. 29, 2000

[54] METHOD FOR AVOIDING FRAUD ON A TAXIMETER OR TACHOGRAPH

[76] Inventor: Claude Ricard, Villa Sainte Madeleine, 52 cours Gambetta, 13100 Aix-En-Provence, France

[21] Appl. No.: 09/115,254

[22] Filed: Jul. 13, 1998

[30] Foreign Application Priority Data

Jul. 16, 1997 [FR] France ..... 97 09237

[51] Int. Cl.[7] ..... G07B 13/00

[52] U.S. Cl. ..... 235/30 R; 235/45; 235/384

[58] Field of Search ..... 235/384, 30 A, 235/30 R, 45, 376, 377, 387

[56] References Cited

U.S. PATENT DOCUMENTS

| | | | |
|---|---|---|---|
| 4,389,563 | 6/1983 | Ricard | 235/30 R X |
| 5,155,747 | 10/1992 | Huang | 364/467 X |
| 5,629,856 | 5/1997 | Ricard | 235/30 R X |

*Primary Examiner*—Michael G Lee
*Attorney, Agent, or Firm*—Richard P. Gilly

[57] ABSTRACT

A method and device for avoiding fraud on a Taximeter or Tachograph, by connecting an auxiliary generator between the censor and the Taximeter or Tachograph. The signal which is applied to the Taximeter or Tachograph is analyzed by sampling, in an anti-fraud action is triggered off if this analysis shows that this signal has undergone a regular amplitude modulation.

11 Claims, 2 Drawing Sheets

METHOD FOR AVOIDING FRAUD ON A TAXIMETER OR TACHOGRAPH

FIELD OF THE INVENTION

The present invention relates to a method for avoiding fraud on a taximeter or a tachograph.

BACKGROUND OF THE INVENTION

Very generally, a taximeter is an apparatus whose object is to indicate the price to be paid for a trip made by the taxi, this price depending on several parameters, including, inter alia, the distance covered by the taxi, i.e. ultimately, the number of wheel turns made by this vehicle during the trip.

The sensor used for measuring this number of wheel turns is in that case the sensor normally associated with the dashboard of the vehicle and therefore connected to the speedometer which indicates both the instantaneous speed of this vehicle and the mileage covered thereby.

Virtually all modern vehicles are equipped with an electromagnetic or electronic sensor for sensing the number of wheel turns, called "electronic sensor", which is provided at the level of the gear box and which is equipped with an output connector on which is connected a cable which collects and conveys the electrical pulses representative of the number of wheel turns to the speedometer which equips the dashboard. The dashboard is in that case conventionally equipped with an auxiliary output, which is electrically connected in parallel on this cable, and on which is connected the corresponding input of the taximeter: the pulses which are conveyed on this cable therefore supply the speedometer of the vehicle and the taximeter simultaneously.

The situation is relatively similar concerning the tachographs with which trucks or lorries must obligatorily be fitted and which, as is known, serve at least to register on a disc the speed of the truck, the miles covered and the driver's work time. In that case, it is generally provided to interpose on the cable which connects the sensor to the speedometer, an electronic adapter which is supplied by the battery through a fuse and which delivers pulses, deducted from those delivered by the sensor, in the direction of the tachograph to which this adapter is connected by an electric cable provided to that end.

These two types of metering apparatus, taximeters or tachographs, are sealed with lead by the Weights and Measures Department, but, unfortunately, this is not sufficient to avoid fraud which is becoming increasingly frequent.

One form of fraud which is frequently encountered at the present time consists in connecting, between the sensor and the taximeter or tachograph, a small auxiliary pulse generator whose frequency is controlled by that of the pulses of the sensor and which consequently delivers pulses whose frequency differs, in a defined ratio which is for example of the order of 1.2, from that of the pulses delivered by this sensor.

In the case of a taximeter for example, the frequency of the pulses which are effectively applied thereto is in that case chosen to be 1.2 times greater than that of the pulses delivered by the sensor, with the result that everything happens as if the taxi is advancing at a speed 1.2 times greater than its real speed, this passing onto the displayed price which is then 1.2 times greater than the price that the client ought in fact to pay.

On the contrary, in the case of a tachograph, the defrauder's apparatus is then adjusted to deliver pulses of frequency 1.2 times less than that of the pulses of the sensor and, for the tachograph, everything happens as if the truck were advancing at a speed 1.2 times less than its real speed.

This ratio can, of course, be manually adjusted most of the time.

It is an object of the invention to prevent any fraud based on a falsification of the speed data which is delivered to the taximeter or to the tachograph.

SUMMARY OF THE INVENTION

To that end, it relates to a method for avoiding fraud on a taximeter or tachograph, the former associated with a taxi and the latter with a truck, both equipped with a sensor which supplies electrical data to said taximeter or tachograph, such as a train of pulses which is representative of the speed of the vehicle. According to the invention, an anti-fraud action is triggered off if it is ascertained that the voltage applied to the taximeter or tachograph and representative of said speed of the vehicle, is modulated in amplitude. Such anti-fraud action typically consists in preventing the taximeter or tachograph from functioning.

Advantageously, said voltage is sampled in order to determine whether it is modulated in amplitude.

According to a particular form of embodiment, in the case of the signals issuing from the sensor and normally applied to the taximeter or tachograph being square or rectangular signals, the high levels and/or the low levels of the waveform are analyzed, and the anti-fraud action is triggered off if, over a given time, there are sufficient values of these levels which are outside a tolerance band, of for example some tenths of Volts, around the mean value of one and/or the other of these levels.

BRIEF DESCRIPTION OF THE DRAWINGS

The invention will be more readily understood on reading the following description of a non-limiting embodiment applied to a taximeter, with reference to the accompanying drawings, in which.

DESCRIPTION OF PREFERRED EMBODIMENT

Figure 1:
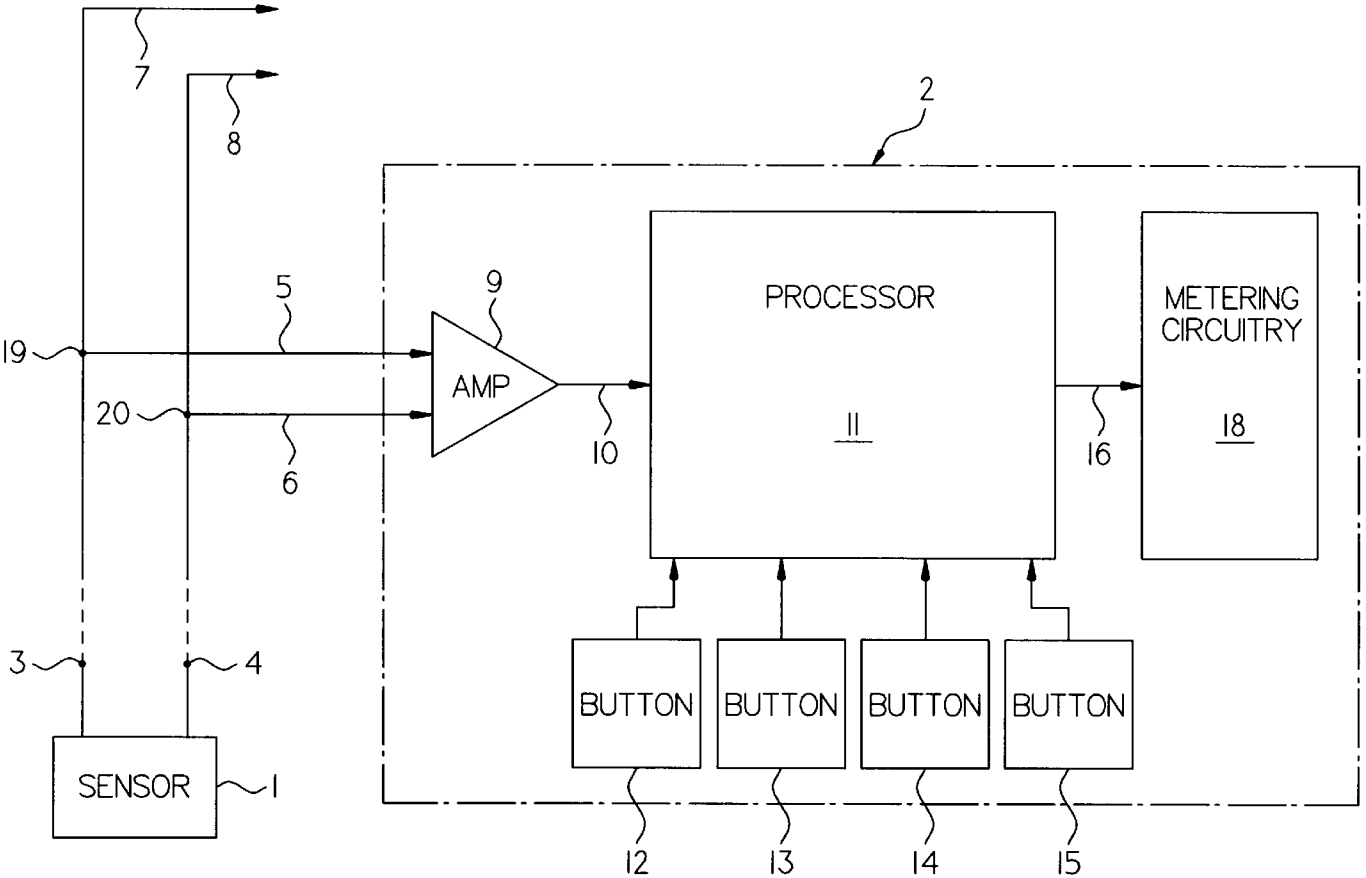
FIG. 1 is a block diagram of the electrical circuit of this taximeter.

Referring now to the drawings, and firstly to FIG. 1, reference 1 designates the electronic tachometric sensor which is mounted on the vehicle to operate the taximeter 2.

A so-called "electronic" tachometric sensor of an automobile vehicle is a transducer which tests a rotating mechanical member of the vehicle, the speed of rotation of this mechanical member being representative of the number of wheel turns made by the vehicle, and the generally A.C. electric signal furnished by this transducer corresponding to electrical pulses representative of this number of wheel turns. Most often, this rotating mechanical member is conventionally one of the pinions of the gear box. However, modem vehicles are being increasingly fitted with a so-called "A.B.S." braking system, which employs an electronic sensor for each wheel of the vehicle, and, in that case, one of these sensors is used to actuate the taximeter. Such vehicles are generally equipped with disc brakes on the four wheels and consequently each electronic sensor is a proximity sensor which tests the presence of notches which are made to that end on the outer edge of the brake disc.

The sensor 1, which is therefore, in practice, placed either at the level of the gear box or at the level of one of the wheels of the vehicle, therefore delivers on its output terminals 3, 4, pulses representative of the number of wheel turns made by the vehicle.

These pulses are applied, on the one hand by connections 5, 6, to the taximeter 2 and, on the other hand by connections 7, 8, to the speed-metering and mile-counting circuits which form part of the dashboard of the vehicle, and possibly to the "A.B.S." braking circuits of this vehicle.

In the taximeter 2, the pulses coming from the sensor 1 are firstly applied to a separation amplifier 9, for example of gain substantially equal to 1, whose output signals are applied on one of the inputs 10 of a microprocessor 11 which constitutes the central processing unit, or "CPU", of this taximeter.

In particular, the microprocessor 11 receives, by pressures exerted on push buttons 12–15 placed on the front face of the taximeter, control signals which are for example either signals of tariffs or of functioning of the taximeter, or parameter signals of the taximeter, or code signals.

As the case may be, when the microprocessor 11 receives pulses coming from the sensor 1 on its input 10, it emits in response, on an output 16, pulses whose frequency is representative, taking into account the parameters previously introduced in the microprocessor 11 via the keyboard 12–15, of the number of wheel turns made by the vehicle from the last time the taximeter was set into operation by means of the keyboard 12–15.

These pulses are applied, as must, to the circuit 18 for metering and displaying the price to be paid.

A possible fraud consists in connecting in series on the tachometric output waveform of the sensor 1, for example between the terminals 3, 4 or the terminals 19, 20 of the connections 5 and 6, a pulse generator which multiplies the rhythm of the incoming pulses by a determined factor (adjusted by hand, if necessary), for example a factor 1.2.

Figures 2A, 2B, 2C:
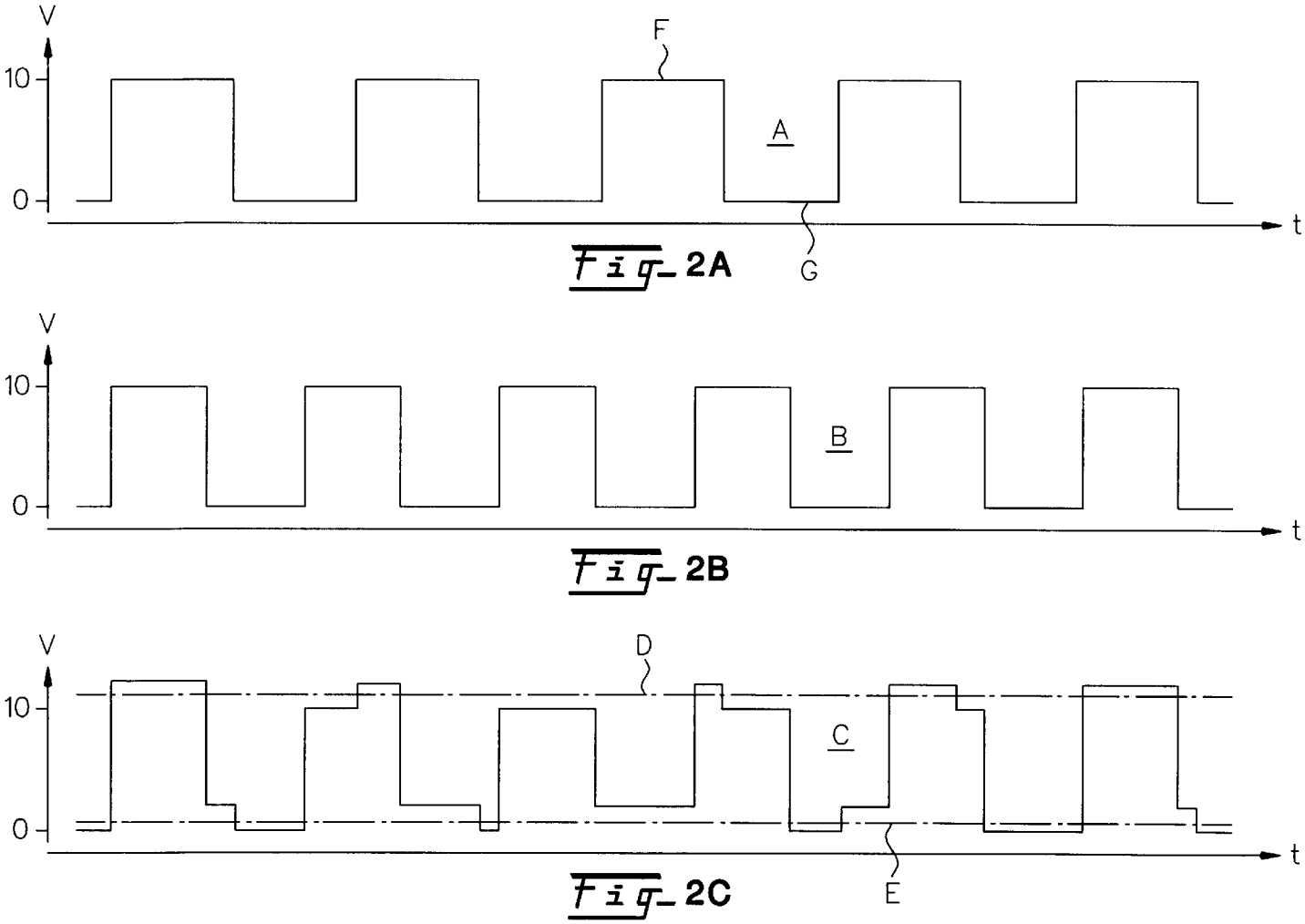
FIGS. 2A–C illustrate a group of three waveforms which will render the invention more comprehensible.

FIGS. 2A, 2B, and 2C show three waveforms A, B, and C, respectively, illustrating variation of the voltage V, in Volts, as a function of time t, of the signals which are effectively applied, by input 5, 6, to the taximeter 2 in the following three cases:

Waveform A: signals effectively applied in the absence of fraud; these are square signals of high levels F of the order of 10 Volts and of low levels G of the order of 0 Volts.

Waveform B: rectangular signals, of the same amplitudes but of frequency 20% higher than that of signals A, which are apparently applied by a defrauder on this same input 5, 6 with the aid of a pulse generator whose impedance is 5 times higher than that of the sensor 1.

Waveform C: signals then effectively applied to the taximeter 2, by superposition of the regular signals A and the fraudulent signals B, taking into account the differences in impedances.

It is then ascertained that the signals of waveform C are indeed substantially rectangular signals, therefore constituted in practice by a succession of high levels of mean value D, and of low levels of mean value E.

On the other hand, the width of each trough is that of the troughs of the fraudulent waveform B, which means that the pulses of waveform C have the same frequency as those of the pulse generator of the defrauder, with the result that the taximeter will measure a speed 20% greater than the real speed of the taxi, and therefore display a price 20% higher than the real price.

In accordance with the invention and therefore in order to avoid this type of fraud based on a falsification of the pulse train emitted by the sensor 1, the microprocessor 11 analyzes, by sampling, the signals which are applied thereto on its input 10.

It therefore takes a large number of successive samples, for example several hundreds, including at least several in each period of the signal, over a determined interval of time.

It calculates the mean value of the high levels and the mean value of the low levels. Supposing there is fraud, it is then question of values D, for example of 11 Volts, and E, for example of 1 Volt, of waveform C.

It then defines, on either side of each mean value, a relatively very narrow tolerance band, for example of plus or minus 0.2 Volts.

It then classifies the values of the high levels, and/or of the low levels, of the samples in three categories for each type of level, high or low:

1. those which are included in the tolerance band,
2. those which are above this tolerance band,
3. those which are below this tolerance band.

In the case of fraud (waveform C), as is shown in the drawing and having regard to the shape of voltage C which is in fact voltage B modulated in amplitude by voltage A, there exists in practice only instantaneous levels which lie outside the tolerance band, high or low. For high levels, for example, they are either 10 Volts or 12 Volts, while their mean value D is 11 Volts and the tolerance band is included between 10.8 and 11.2 Volts.

Of course, it is also possible to have values included in the tolerance band, by reason of the random noises, but in any case, there will be more, and in any case several times more, or even more than 10 times more, values outside this band.

The microprocessor 11 then ascertains that there is fraud, and consequently it controls blockage of the taximeter.

The latter then displays an error signal and it can be put into service again only by typing on the keyboard 12–15 a secret code known only to the accredited technicians.

On the contrary, if there is no fraud and it is therefore waveform A which is applied to the taximeter 2, the mean value of the high levels corresponds virtually to the high level F of the pulses and the mean value of the low levels corresponds to the low level G of the pulses. In such a case, almost all the signals sampled will be included in the corresponding tolerance band, high or low, to within the minority random noise signals, and the microprocessor 11 does not trigger off anti-fraud action.

It goes without saying that the invention is not limited to the embodiment which has just been described. For example, in the case of fraud according to waveform C, analysis of the sampling signals may consist in reconstituting this waveform C from these samples, and in then determining whether it is indeed a voltage which, although having the general appearance of a succession of substantially rectangular signals, is modulated in amplitude regularly, and therefore repetitively. On waveform C of FIG. 2C, an amplitude modulation is for example observed which extends, in accordance with a certain law, over 5 successive troughs, then resumes identically over the following 5 troughs, and so on.

Similarly, in the case of waveforms A and B being sine waveforms and not square or rectangular signals, analysis after sampling then consists in determining whether or not the resultant voltage C is a sine wave modulated regularly in amplitude.

Similarly, the method may generally consist in measuring the high and/or low peak voltages for a certain number of high levels and/or low levels of said voltage, whatever its periodic form, in examining the variations of these peak voltages, and in triggering off anti-fraud action if, over a given time, there is a certain number of these variations which are of sufficient amplitude, for example greater than some tenths of Voltages. Typically, the mean value of these high and/or low peak voltages is calculated and the anti-fraud action is triggered off if, over this given time, there is more than a certain number of peak voltage values which differ sufficiently, for example by more than some tenths of voltages, from this mean value.

In order to trigger off anti-fraud action, the periodicity of said modulation may also be examined.

In accordance with a form of embodiment of the method, the variation of the voltage C may be analyzed by a Fast Fourier Transform (FFT).

What is claimed is:

1. A method for avoiding fraud on a taximeter or tachograph associated with a vehicle, the taximeter or the tachograph including a sensor which supplies electrical data to said taximeter or tachograph, such as a train of pulses which is representative of the speed of the vehicle, the method comprising the step wherein an anti-fraud action is triggered if voltage applied to the taximeter or tachograph and representative of said speed of the vehicle is modulated in amplitude.

2. The method of claim 1, wherein said anti-fraud action comprises preventing the taximeter or tachograph from functioning.

3. The method of claim 1, wherein said voltage is sampled in order to determine whether said voltage is modulated in amplitude.

4. The method of claim 1, wherein square or rectangular waveform signals are issued from the sensor and applied to the taximeter or tachograph, and wherein the high levels and/or the low levels of the waveform signals are analyzed and the anti-fraud action is triggered if, over a given time, there are sufficient values of these levels which are outside a tolerance band around a corresponding mean value of one and/or the other of these levels.

5. The method of claim 1, wherein high and/or low peaks of the voltage applied to the taximeter or tachograph are measured for a certain number of high levels and/or low levels of said voltage, variations of these peak voltages are examined, and the anti-fraud action is triggered if, over a given time, there are a certain number of these variations of sufficient amplitude.

6. The method of claim 5, wherein a mean value of these high and/or low peak voltages is calculated, and the anti-fraud action is triggered if more than a certain number of values of peak voltages differ sufficiently from the mean value.

7. The method of claim 5, wherein the periodicity of the modulation is examined in order to trigger the anti-fraud action.

8. The method of claim 1, further comprising the steps of effecting sampling, analysis of the voltage, and control of the anti-fraud action by a central processing unit of the taximeter or tachograph.

9. The method of claim 1, wherein variation of the voltage is analyzed by a Fast Fourier Transform (FFT).

10. A method for triggering an anti-fraud action on a taximeter or tachograph of a vehicle, wherein a sensor provides a first signal representing speed of the vehicle and the taximeter or tachograph receives a second signal, the method comprising the steps of:

a) determining whether the second signal is a modulated version of the first signal; and b) triggering an anti-fraud action if the second signal is determined to be modulated.

11. A method according to claim 10 wherein the first signal is a substantially rectangular waveform having corresponding high and low levels, and step (a) includes:

sampling the second signal;

calculating at least one of a mean high value and a mean low value corresponding to the second signal; and determining a number of samples of the second signal which are outside a tolerance band around the at least one of the mean high value and the mean low value during a predetermined time; and step (b) includes triggering the anti-fraud action if the determined number of samples outside exceeds a predetermined value.

* * * * *